US011779510B2

(12) United States Patent
Li

(10) Patent No.: US 11,779,510 B2
(45) Date of Patent: Oct. 10, 2023

(54) NECK AND SHOULDER MASSAGING MECHANISM

(71) Applicant: XIAMEN COMFIER TECHNOLOGY CO., LTD., Fujian (CN)

(72) Inventor: Jianqing Li, Xiamen (CN)

( * ) Notice: Subject to any disclaimer, the term of this patent is extended or adjusted under 35 U.S.C. 154(b) by 679 days.

(21) Appl. No.: 16/755,886

(22) PCT Filed: Aug. 31, 2018

(86) PCT No.: PCT/CN2018/103418
§ 371 (c)(1),
(2) Date: Apr. 14, 2020

(87) PCT Pub. No.: WO2020/042131
PCT Pub. Date: Mar. 5, 2020

(65) Prior Publication Data

US 2020/0297575 A1 Sep. 24, 2020

(51) Int. Cl.
*A61H 15/00* (2006.01)

(52) U.S. Cl.
CPC ... *A61H 15/0078* (2013.01); *A61H 2015/005* (2013.01); *A61H 2201/1215* (2013.01); *A61H 2201/1427* (2013.01); *A61H 2201/1661* (2013.01); *A61H 2201/1671* (2013.01); *A61H 2205/04* (2013.01); *A61H 2205/062* (2013.01)

(58) Field of Classification Search
CPC ..... A61H 15/0078; A61H 2015/005; A61H 2201/1215; A61H 2201/1427; A61H 2201/1661; A61H 2201/1671; A61H 2201/0149; A61H 2201/0146; A61H 2201/0142; A61H 2201/0138; A61H 2205/062; A61H 2205/04
See application file for complete search history.

(56) References Cited

U.S. PATENT DOCUMENTS 5,904,436 A * 5/1999 Maughan ..... F16C 11/0647 403/135
2004/0183345 A1* 9/2004 Furuie ..... A61H 7/007 297/217.1
2005/0192520 A1* 9/2005 Morita ..... A61H 15/0078 601/102
2009/0124940 A1* 5/2009 Nishio ..... A61H 7/007 601/134

(Continued)

FOREIGN PATENT DOCUMENTS

CN 107374897 A * 11/2017 ..... A61H 1/00

*Primary Examiner* — Colin W Stuart
*Assistant Examiner* — Douglas Y Sul

(57) ABSTRACT

A neck and shoulder massaging mechanism includes a housing, a neck massaging assembly, a shoulder massaging assembly, an eccentric assembly, a connection assembly, and a rotating shaft. The eccentric assembly is disposed on the rotating shaft. The eccentric assembly is linked to the neck massaging assembly to perform an eccentric oscillating movement. The connection assembly includes a first spherical cavity, a ball connecting rod, and a second spherical cavity. Spherical members at two ends of the ball connecting rod are accommodated within the first spherical cavity and the second spherical cavity, respectively. The neck and shoulder massaging mechanism has characteristics of a simple structure and large eccentric oscillating amplitude.

8 Claims, 7 Drawing Sheets

(56) References Cited

U.S. PATENT DOCUMENTS

| | | | | |
|---|---|---|---|---|
| 2017/0231860 | A1* | 8/2017 | Zou | A61H 15/0078<br>601/134 |
| 2017/0258669 | A1* | 9/2017 | Ishikawa | A61H 23/006 |
| 2017/0360641 | A1* | 12/2017 | Nakata | A61H 1/003 |
| 2018/0125741 | A1* | 5/2018 | Lin | A61H 7/007 |
| 2019/0053971 | A1* | 2/2019 | Pan | A61H 7/007 |

* cited by examiner

NECK AND SHOULDER MASSAGING MECHANISM

BACKGROUND OF THE INVENTION

1. Field of the Invention

The present invention relates to a massaging apparatus, and more particularly to a neck and shoulder massaging mechanism.

2. Description of the Prior Art

A massage device is a novel health care apparatus developed based on physics, bionics, bioelectricity, traditional Chinese medicine and many years of clinical practice. It usually works with several independent soft massaging heads, which can relax muscles, soothe nerves, promote blood circulation, strengthen cell metabolism, enhance skin elasticity, relieve fatigue, significantly reduce all kinds of chronic pain, acute pain and muscle soreness, and relax the body and relieve pressure.

A conventional neck and shoulder massaging mechanism includes a neck massaging assembly and a shoulder massaging assembly. The neck massaging assembly and the shoulder massaging assembly are connected through a connecting rod. The neck massaging assembly will be affected by the shoulder massaging assembly, resulting in small eccentric oscillation amplitude of the neck massaging assembly.

Accordingly, the inventor of the present invention has devoted himself based on his many years of practical experiences to solve these problems.

SUMMARY OF THE INVENTION

The primary object of the present invention is to provide a neck and shoulder massaging mechanism that has a simple structure and provides large eccentric oscillating amplitude.

In order to achieve the above object, the present invention adopts the following technical solutions:

A neck and shoulder massaging mechanism comprises a housing, a neck massaging assembly, a shoulder massaging assembly, an eccentric assembly, a connection assembly, and a rotating shaft driven by a motor to rotate. The neck massaging assembly, the shoulder massaging assembly, the eccentric assembly, the connection assembly, the motor and the rotating shaft are accommodated in the housing. The eccentric assembly is disposed on the rotating shaft. The neck massaging assembly is fitted on the eccentric assembly. The eccentric assembly is linked to the neck massaging assembly to perform an eccentric oscillating movement. One end of the neck massaging assembly is defined as an eccentric oscillating end. One end of the shoulder massaging assembly is defined as an oscillating end. A middle portion of the shoulder massaging assembly is fixed to the housing. The connection assembly includes a first spherical cavity disposed at one side of the neck massaging assembly, a ball connecting rod having two ends provided with spherical members, and a second spherical cavity disposed at another end of the shoulder massaging assembly. The spherical members at the two ends of the ball connecting rod are respectively accommodated within the first spherical cavity and the second spherical cavity so that the neck massaging assembly is linked to the shoulder massaging assembly.

Preferably, the motor drives the rotating shaft to rotate through a gear assembly. One end of the motor is provided with a worm. The worm is meshed with the gear assembly. The rotating shaft is inserted through the gear assembly.

Preferably, the gear assembly includes a first driving gear, a second driving gear, and a first driven gear. The first driven gear is fixed on the rotating shaft. The worm is meshed with the first driving gear. The first driving gear is coaxially linked with the second driving gear. The first driven gear is meshed with the second driving gear.

Preferably, an inside of the housing is divided into a massaging assembly chamber, a motor chamber and a gear assembly chamber by partitions.

Preferably, the housing includes a lower housing chamber and an upper cover. The upper cover is configured to cover the motor chamber and the gear assembly chamber. The partitions are disposed in the lower housing chamber.

Preferably, the eccentric assembly includes a first bevel wheel and a second bevel wheel. The inclined directions of the opposing surfaces of the first bevel wheel and the second bevel wheel are opposite. The first bevel wheel is provided with a first cylinder extending toward the second bevel wheel. The neck massaging assembly is fitted onto the first cylinder. The second bevel wheel is fixed to the first cylinder. The rotating shaft is inserted through the second bevel wheel, the neck massaging assembly and the first bevel wheel in sequence.

Preferably, the neck massaging assembly includes a first massaging ann and two misaligned first massaging heads. The first massaging heads are disposed on two sides of an eccentric oscillating end of the first massaging ann, respectively. The first massaging ann has a cylindrical hole for the first cylinder to pass through. Each of the first spherical cavity and the second first spherical cavity is formed by two half cavities. One half cavity of each of the first spherical cavity and the second first spherical cavity is formed separately. The other half cavity of the first spherical cavity is convexly provided on one side of the first massaging arm. The shoulder massaging assembly includes a second massaging arm and a second massaging head. The second massaging head is disposed at an oscillating end of the second massaging arm. A middle portion of the second massaging ann is fixed to the housing. The other half cavity of the second spherical cavity is protruded from another end of the second massaging ann.

Preferably, another end of the neck massaging assembly is provided with a ball rod. One end of the ball rod has a spherical head. The housing is provided with a groove corresponding in position to the spherical head. The spherical head is confined and slidable in the groove.

According to the present invention, a universal joint structure is formed by the cooperation of the spherical members at the two ends of the ball connecting rod and the first spherical cavity and the second spherical cavity, so that the influence of the shoulder massaging assembly on the neck massaging assembly becomes small. The amplitude of the eccentric oscillation of the neck massaging assembly becomes larger. The oscillation of the shoulder massaging assembly is slower than the eccentric oscillation of the neck massaging assembly. The invention changes the traditional massaging manner, provides a new massaging experience, and has a simple structure.

DETAILED DESCRIPTION OF THE PREFERRED EMBODIMENTS

Figure 1:
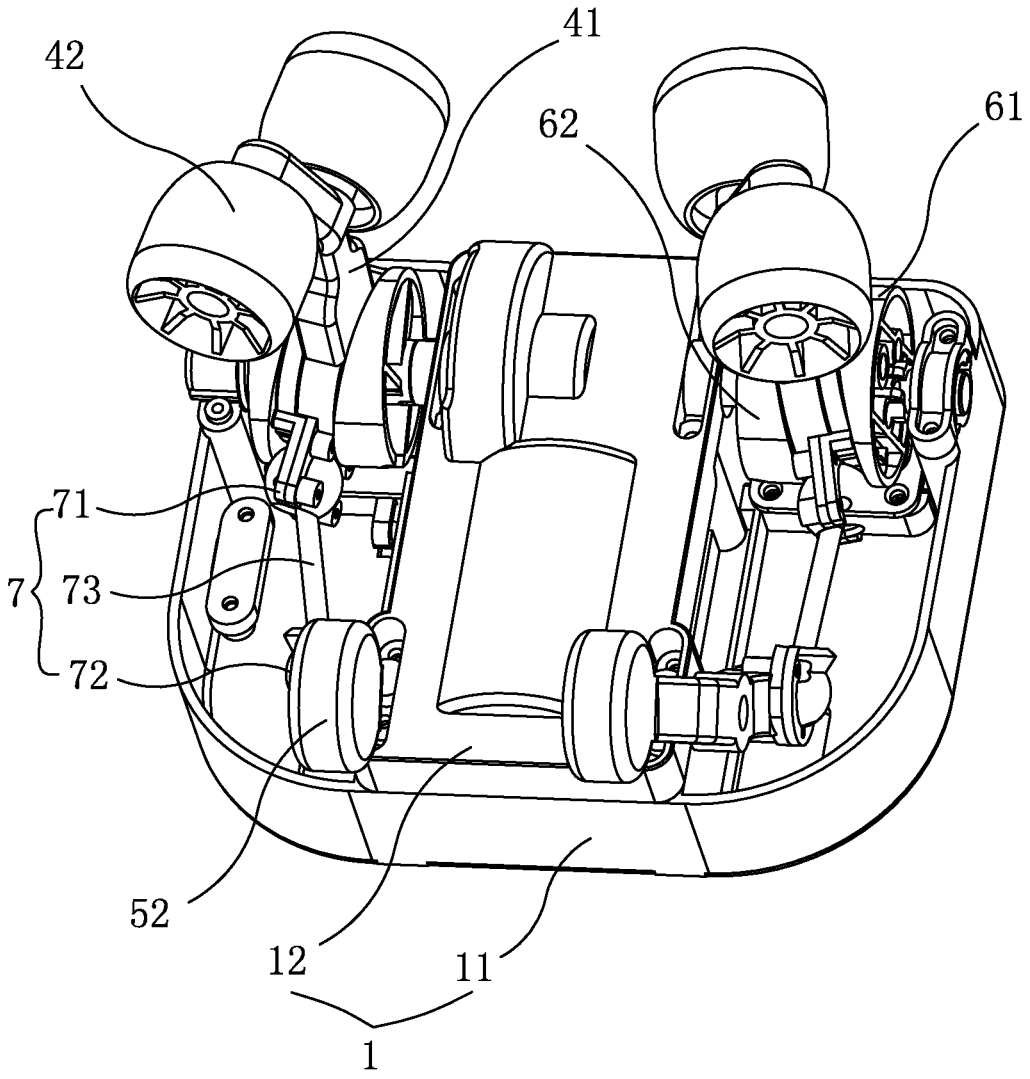
FIG. 1 is a perspective view of the present invention.

Embodiments of the present invention will now be described, by way of example only, with reference to the accompanying drawings.

As shown in FIG. 1 through FIG. 9, the present invention discloses a neck and shoulder massaging mechanism. The neck and shoulder massaging mechanism comprises a housing 1, a neck massaging assembly 4, a shoulder massaging assembly 5, an eccentric assembly 6, a connection assembly 7, and a rotating shaft 3 driven by a motor 2 to rotate. The neck massaging assembly 4, the shoulder massaging assembly 5, the eccentric assembly 6, the connection assembly 7, the motor 2 and the rotating shaft 3 are accommodated in the housing 1. The number of the neck massaging assembly 4, the shoulder massaging assembly 5, the eccentric assembly 6, the connection assembly 7, the motor 2 and the rotating shaft 3 described in this technical solution is not limited, and the user can select and set as required. This embodiment includes a pair of neck massaging assemblies 4, a pair of shoulder massaging assemblies 5, a pair of eccentric assemblies 6, a pair connection assemblies 7, one motor 2, and one rotating shaft 3.

Figure 2:
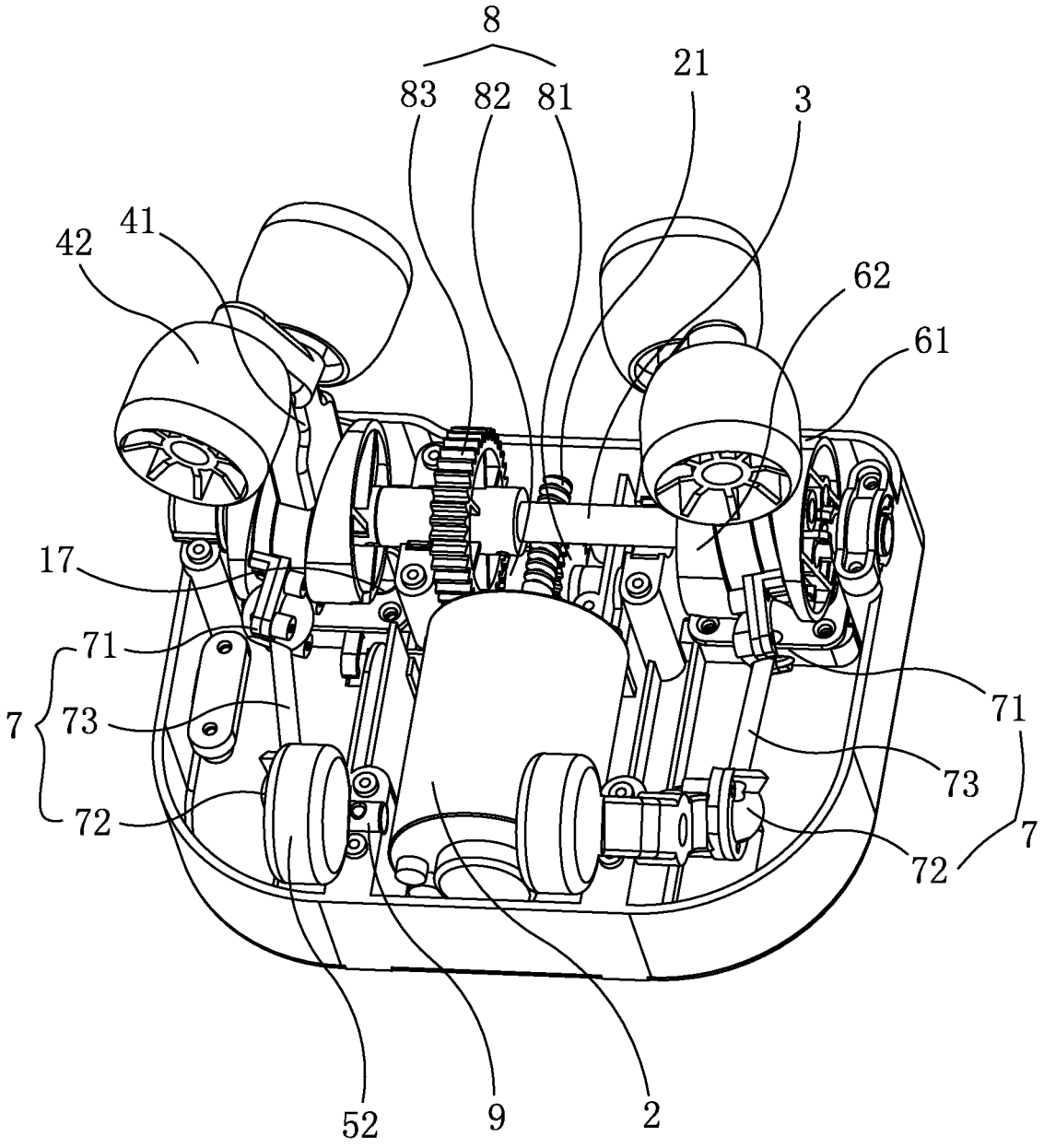
FIG. 2 is a perspective view of the present invention after the upper cover is removed.
Figure 3:
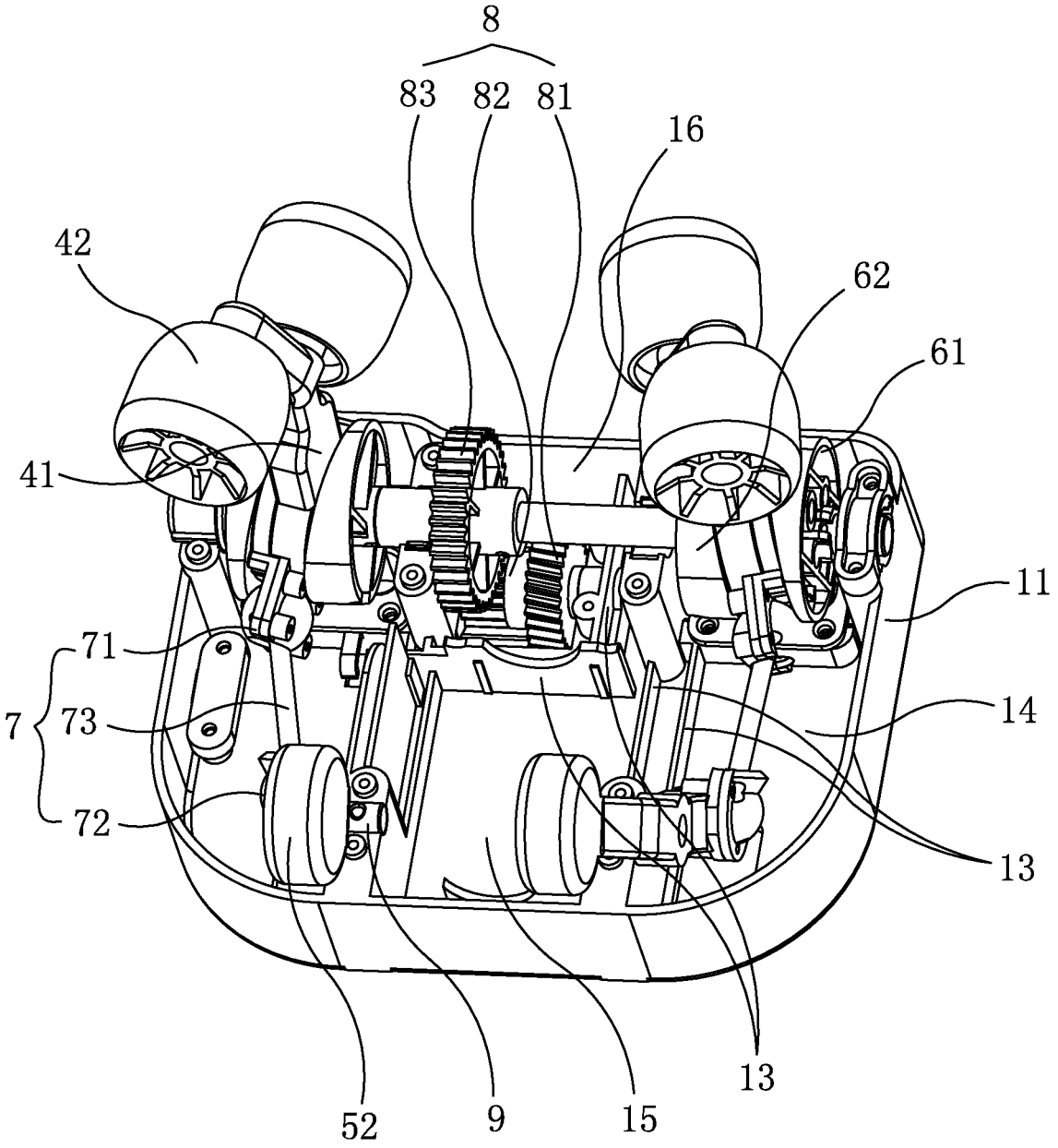
FIG. 3 is a perspective view of FIG. 2, without the motor.
Figure 4:
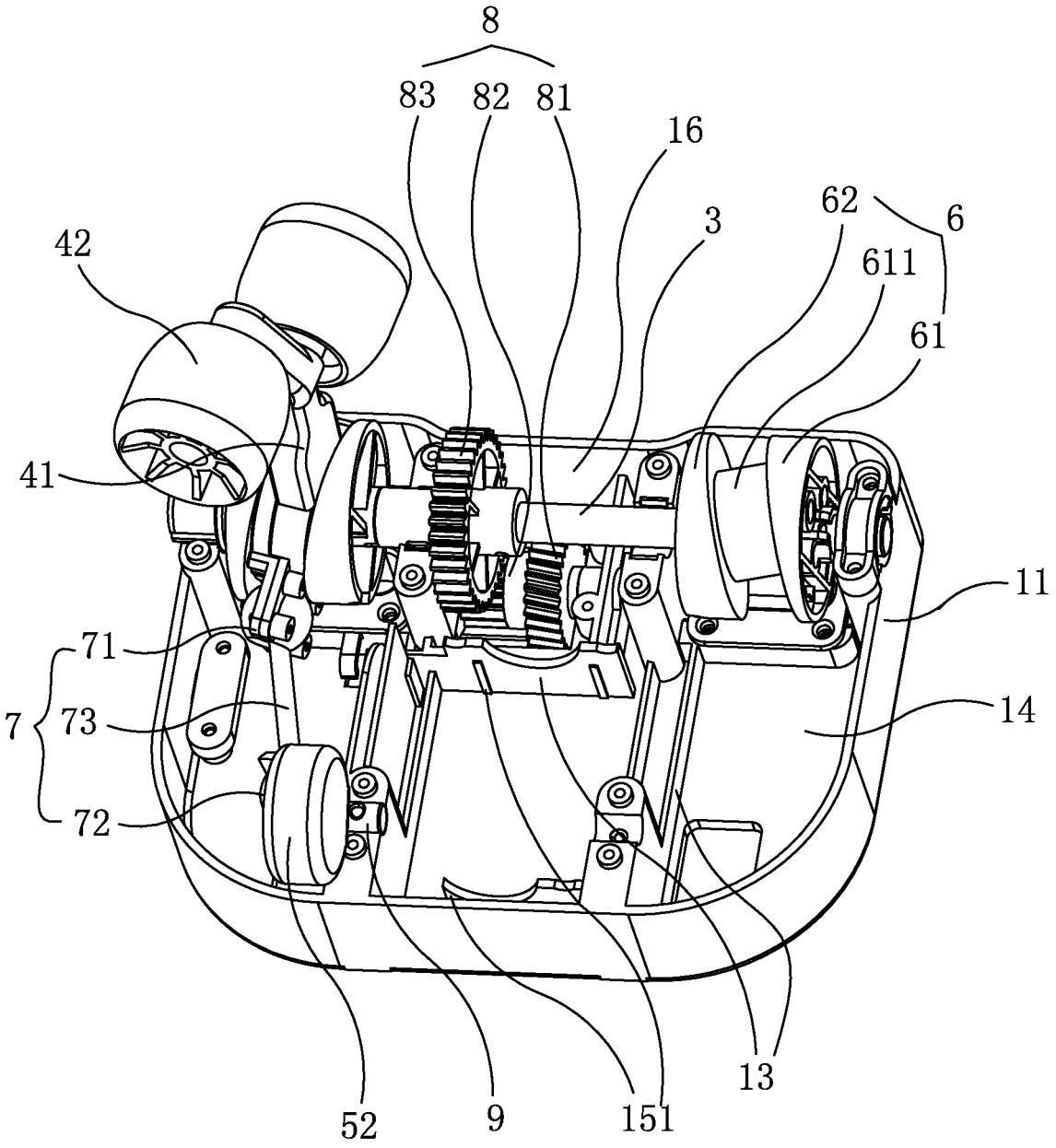
FIG. 4 is a perspective view of FIG. 3, wherein one neck massaging assembly, the connection assembly and the shoulder massaging assembly are removed.

Referring to FIG. 1 through FIG. 3, the housing 1 includes a lower housing chamber 11 and an upper cover 12. The lower housing chamber 11 is provided with a plurality of partitions 13 to partition the lower housing chamber 11 into a massaging assembly chamber 14, a motor chamber 15 and a gear assembly chamber 16, thereby preventing the components of the present invention from affecting each other during operation. The upper cover 12 is configured to cover the motor chamber 15 and the gear assembly chamber 16. This makes the present invention beautiful and prevents the motor 2 and a gear assembly 8 from being affected by the external things. In this embodiment, the upper cover 12 is fixed to the partitions 13 corresponding to the motor chamber 15 and the gear assembly chamber 16 through fixing members. As shown in FIG. 4, a plurality of limiting blocks 151 are fixed on the inner wall of the motor chamber 15, and the motor 2 is limited and fixed by the limiting blocks 151.

In this embodiment, the motor 2 drives the rotating shaft 3 to rotate through the gear assembly 8. One end of the motor 2 is provided with a worm 21. The worm 21 is meshed with the gear assembly 8. The rotating shaft 3 is inserted through the gear assembly 8. However, the manner in which the motor 2 drives the rotating shaft 3 is not limited thereto. The motor 2 may drive the rotating shaft 3 to rotate through the cooperation between a belt and a pulley. Other mechanical structures may be used for the motor 2 to drive the rotating shaft 3 to rotate.

The gear assembly 8 is accommodated in the gear assembly chamber 16. The gear assembly 8 includes a first driving gear 81, a second driving gear 82, and a first driven gear 83. The first driven gear 83 is fixed on the rotating shaft 3. The worm 21 is meshed with the first driving gear 81. The first driving gear 81 is coaxially linked with the second driving gear 82. The first driven gear 83 is meshed with the second driving gear 82. According to the present invention, the first driving gear 81 is coaxially linked with the second driving gear 82, so that the installation position of the motor 2 can be flexibly changed. Only by changing the positional relationship between the first driving gear 81 and the second driving gear 82, the motor 2 can drive the first driven gear 83 to rotate, so that the rotating shaft 3 is rotated. The coaxial two ends of the first driving gear 81 and the second driving gear 82 are rotatably connected to the two side walls of the gear assembly chamber 16, respectively.

Figure 7:
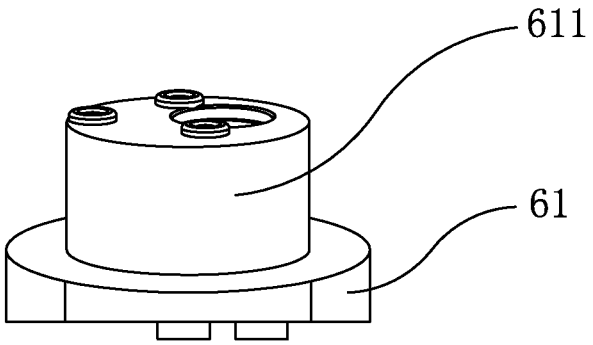
FIG. 7 is a perspective view of the first bevel wheel of the present invention.
Figure 8:
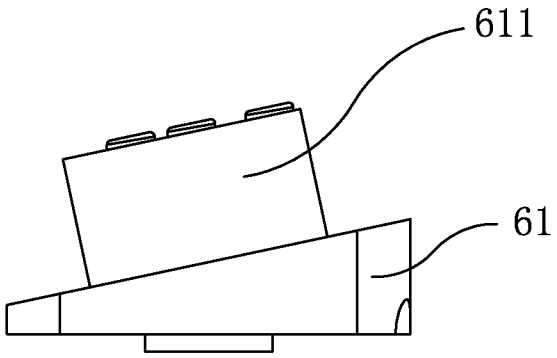
FIG. 8 is a left view of FIG. 7.
Figure 9:
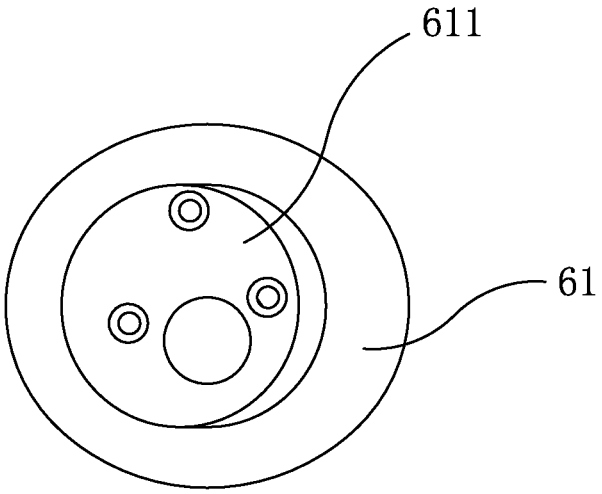
FIG. 9 is a top view of FIG. 7.

Please refer to FIG. 7 through FIG. 9. The eccentric assembly 6 is disposed on the rotating shaft 3. The eccentric assembly 6 includes a first bevel wheel 61 and a second bevel wheel 62. The first bevel wheel 61 is provided with a first cylinder 611 extending toward the second bevel wheel 62. The second bevel wheel 62 is fixed to the first cylinder 611. The eccentric assembly 6 is linked to the neck massaging assembly 4 to perform an eccentric oscillating movement.

Please refer to FIG. 1 through FIG. 6. The neck massaging assembly 4 is sleeved on the eccentric assembly 6. One end of the neck massaging assembly 4 is defined as an eccentric oscillating end. The neck massaging assembly 4 includes a first massaging arm 41, two misaligned first massaging heads 42, and a second cylinder 43. The first massaging heads 42 are disposed on two sides of an eccentric oscillating end of the first massaging ann 41, respectively. The first massaging ann 41 has a cylindrical hole 44 for the first cylinder 611 to pass through. A third cylinder 45 is protruded from the edge of the cylindrical hole 44 toward the second bevel wheel 62. The second cylinder 43 is sleeved onto the third cylinder 45 and is fixed to the first massaging ann 41. The first spherical cavity 71 is formed by two half cavities. One half cavity of the first spherical cavity 71 is convexly provided on one side of the second cylinder 43. The other half cavity of the first spherical cavity 71 is convexly provided on one side of the first massaging ann 41.

One end of the shoulder massaging assembly 5 is defined as an oscillating end. The shoulder massaging assembly 5 includes a second massaging arm 51 and a second massaging head 52. The second massaging head 52 is disposed at an oscillating end of the second massaging ann 51. A middle portion of the second massaging ann 51 is fixed to the housing 1. The second spherical cavity 72 is formed by two half cavities. One half cavity of the second spherical cavity 72 is formed separately, and the other half cavity of the second spherical cavity 72 is protruded from the other end of the second massaging ann 51. The neck massaging assembly 4 is sleeved on the first cylinder 611 through the cylindrical hole 44. The rotating shaft 3 is inserted through the second bevel wheel 62, the cylindrical hole 44 and the first bevel wheel 61 in sequence, and the two ends of the rotating shaft 3 are rotatably connected to two side walls of the lower housing chamber 11, respectively. The middle portion of the second massaging ann 51 is fixed to the side wall of the corresponding motor chamber 15 through a bolt 9, and the second massaging head 52 extends out of the motor chamber 15, so that the second massaging head 52 can oscillate flexibly.

Figure 5:
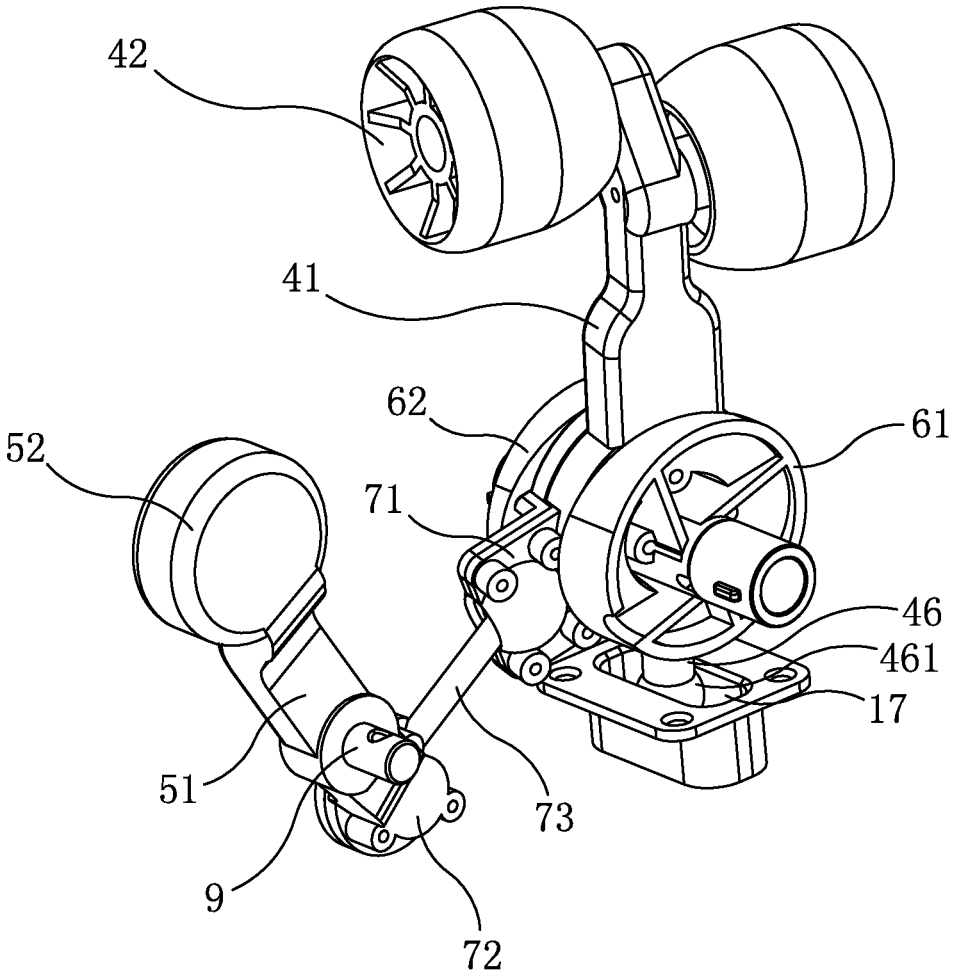
FIG. 5 is a partial perspective view of the present invention.
Figure 6:
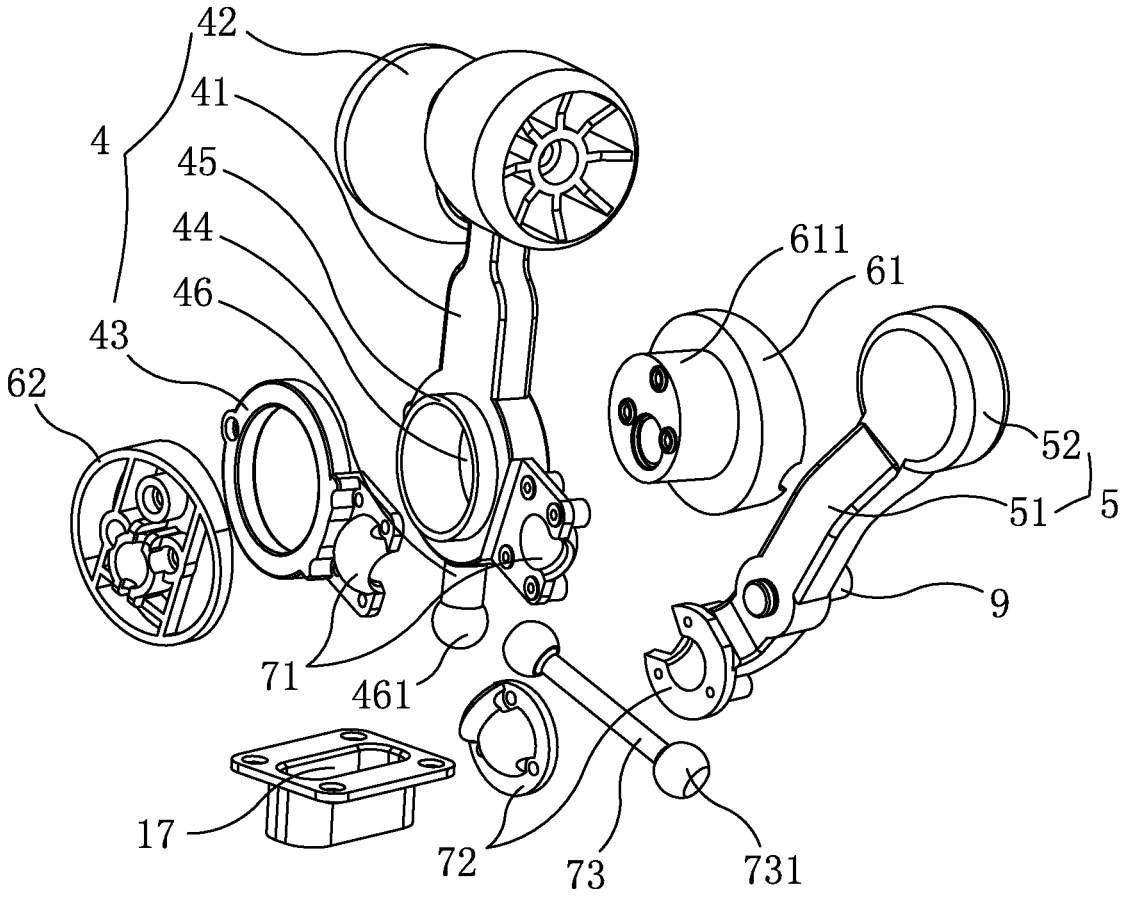
FIG. 6 is an exploded view of FIG. 5.

Referring to FIG. 5 and FIG. 6, the other end of the first massaging ann 41 is provided with a ball rod 46. One end of the ball rod 46 has a spherical head 461. The lower housing chamber 11 is provided with a groove 17 corresponding in position to the spherical head 461. The spherical head 461 is confined and slidable in the groove 17. By the cooperation of the spherical head 461 and the groove 17, the eccentric oscillation of the first massaging ann 41 is limited, so as to prevent the eccentric oscillation of the first massaging arm 41 from being excessive.

The connection assembly 7 includes a first spherical cavity 71 disposed at one side of the neck massaging assembly 4, a ball connecting rod 73 having two ends provided with spherical members 731, and a second spherical cavity 72 disposed at the other end of the shoulder massaging assembly 5. The spherical members 731 at the two ends of the ball connecting rod 73 are respectively accommodated within the first spherical cavity 71 and the second spherical cavity 72, such that the neck massaging assembly 4 is linked to the shoulder massaging assembly 5.

According to the present invention, a universal joint structure is formed by the cooperation of the spherical members 731 at the two ends of the ball connecting rod 73 and the first spherical cavity 71 and the second spherical cavity 72, so that the influence of the shoulder massaging assembly 5 on the neck massaging assembly 4 becomes small. The eccentric oscillation of both ends of the ball connecting rod 73 is more flexible and the angle of eccentric oscillation is larger, so that the amplitude of the eccentric oscillation of the neck massaging assembly 4 becomes larger. The oscillation of the shoulder massaging assembly 5 is slower than the eccentric oscillation of the neck massaging assembly 4. The invention changes the traditional massaging manner, provides a new massaging experience, and has a simple structure.

When in use, the motor 22 drives the rotating shaft 3 to rotate by linking the gear assembly 8. Through the action of the eccentric assembly 6, the rotary motion of the rotating shaft 3 is converted into a composite motion of the first massage arm 41 formed by the left-right oscillation and the up-down motion. The second massaging ann 52 is connected to the first massaging ann 41 through the connection assembly 7, so that the motion of the first massaging ann 41 is converted into an arc-shaped motion. When the first massaging ann 41 moves toward the center, the second massaging ann 52 approaches the first massaging ann 41; when the first massaging ann 42 moves away from the center, the second massaging ann 52 moves away from the first massaging ann 42, thereby forming a massage action on the neck and shoulders.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. A neck and shoulder massaging mechanism, comprising a housing, a neck massaging assembly, a shoulder massaging assembly, an eccentric assembly, a connection assembly, and a rotating shaft driven by a motor to rotate;

the neck massaging assembly, the shoulder massaging assembly, the eccentric assembly, the connection assembly, the motor and the rotating shaft being accommodated in the housing;

the eccentric assembly being disposed on the rotating shaft, the neck massaging assembly being fitted on the eccentric assembly, the eccentric assembly being linked to the neck massaging assembly to perform an eccentric oscillating movement, one end of the neck massaging assembly being defined as an eccentric oscillating end, one end of the shoulder massaging assembly being defined as an oscillating end, a middle portion of the shoulder massaging assembly being fixed to the housing;

the connection assembly including a first spherical cavity disposed at one side of the neck massaging assembly, a ball connecting rod having two ends provided with spherical members, and a second spherical cavity disposed at another end of the shoulder massaging assembly, the spherical members at the two ends of the ball connecting rod being respectively accommodated within the first spherical cavity and the second spherical cavity to form two ball joints respectively at the two ends of the ball connecting rod, the ball connecting rod being directly connected to the neck massaging assembly and the shoulder massaging assembly with the two ball joints so that the neck massaging assembly is linked to the shoulder massaging assembly by the ball connecting rod of which the two ends are directly connected to the neck massaging assembly and the shoulder massaging assembly by the ball joints, wherein the neck massaging assembly is in direct connection with the eccentric assembly, and the shoulder massaging assembly is in indirect connection with the eccentric assembly by means of only the two ball joints at the two ends of the ball connecting rod, such that interconnection between the neck massaging assembly and the shoulder massaging assembly includes only two ball joints interfacing therebetween.

2. The neck and shoulder massaging mechanism as claimed in claim 1, wherein the motor drives the rotating shaft to rotate through a gear assembly, one end of the motor is provided with a worm, the worm is meshed with the gear assembly, and the rotating shaft is inserted through the gear assembly.

3. The neck and shoulder massaging mechanism as claimed in claim 2, wherein the gear assembly includes a first driving gear, a second driving gear and a first driven gear, the first driven gear is fixed on the rotating shaft, the worm is meshed with the first driving gear, the first driving gear is coaxially linked with the second driving gear, and the first driven gear is meshed with the second driving gear.

4. The neck and shoulder massaging mechanism as claimed in claim 2, wherein an inside of the housing is divided into a massaging assembly chamber, a motor chamber and a gear assembly chamber by partitions.

5. The neck and shoulder massaging mechanism as claimed in claim 4, wherein the housing includes a lower housing chamber and an upper cover, the upper cover is configured to cover the motor chamber and the gear assembly chamber, and the partitions are disposed in the lower housing chamber.

6. The neck and shoulder massaging mechanism as claimed in claim 1, wherein the eccentric assembly includes a first bevel wheel and a second bevel wheel, the first bevel wheel is provided with a first cylinder extending toward the second bevel wheel, the neck massaging assembly is fitted onto the first cylinder, the second bevel wheel is fixed to the first cylinder, and the rotating shaft is inserted through the second bevel wheel, the neck massaging assembly and the first bevel wheel in sequence.

7. The neck and shoulder massaging mechanism as claimed in claim 6, wherein the neck massaging assembly includes a first massaging arm and two misaligned first massaging heads, the first massaging heads are respectively disposed on two sides of an eccentric oscillating end of the first massaging arm, the first massaging arm has a cylindrical hole for the first cylinder to pass through, each of the first spherical cavity and the second first spherical cavity is formed by two half cavities, one half cavity of each of the first spherical cavity and the second first spherical cavity is formed separately, the other half cavity of the first spherical cavity is convexly provided on one side of the first massaging arm, the shoulder massaging assembly includes a second massaging arm and a second massaging head, the second massaging head is disposed at an oscillating end of the second massaging arm, a middle portion of the second massaging arm is fixed to the housing, and the other half cavity of the second spherical cavity is protruded from another end of the second massaging arm.

8. The neck and shoulder massaging mechanism as claimed in claim 1, wherein another end of the neck massaging assembly is provided with a ball rod, one end of the ball rod has a spherical head, the housing is provided with a groove corresponding in position to the spherical head, and the spherical head is confined and slidable in the groove.

* * * * *